US009607816B2

(12) United States Patent
Bajic et al.

(10) Patent No.: US 9,607,816 B2
(45) Date of Patent: Mar. 28, 2017

(54) TWO-DIMENSIONAL SEPARATION AND IMAGING TECHNIQUE FOR THE RAPID ANALYSIS OF BIOLOGICAL SAMPLES

(71) Applicant: Micromass UK Limited, Wilmslow (GB)

(72) Inventors: Stevan Bajic, Sale (GB); Paul Robert Murray, Manchester (GB); Mark William Towers, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/971,129

(22) Filed: Dec. 16, 2015

(65) Prior Publication Data

US 2016/0181075 A1 Jun. 23, 2016

(30) Foreign Application Priority Data

Dec. 17, 2014 (EP) ..... 14198413
Dec. 17, 2014 (GB) ..... 1422421.6

(51) Int. Cl.
*H01J 49/00* (2006.01)
*H01J 49/16* (2006.01)

(52) U.S. Cl.
CPC ..... *H01J 49/0004* (2013.01); *H01J 49/164* (2013.01)

(58) Field of Classification Search
CPC ..... H01J 49/00; H01J 49/02; H01J 49/0004; H01J 49/0027; H01J 49/0095; H01J 49/0409; H01J 49/0413; H01J 49/0418; H01J 49/0431; H01J 49/0436; G01N 2030/388
USPC ..... 250/281, 282, 285, 288
See application file for complete search history.

(56) References Cited

U.S. PATENT DOCUMENTS

| | | | |
|---|---|---|---|
| 3,356,071 | A | 12/1967 | Brown |
| 3,986,452 | A | 10/1976 | Dahlgren |
| 5,427,663 | A | 6/1995 | Austin et al. |
| 6,579,719 | B1 | 6/2003 | Hutchens et al. |
| 7,667,196 | B2 | 2/2010 | Schurenberg et al. |

(Continued)

FOREIGN PATENT DOCUMENTS

| | | |
|---|---|---|
| JP | 2012003898 | 1/2012 |
| WO | 03/091723 | 11/2003 |

(Continued)

OTHER PUBLICATIONS

Jokinen et al., "*Engineered Droplets for Dried Droplet Solute Deposition by Mass Spectrometric Imaging*", Microfluid Nanofluid, vol. 11, pp. 145-156, 2011.

*Primary Examiner* — Jason McCormack
(74) *Attorney, Agent, or Firm* — Diederiks & Whitelaw, PLC

(57) ABSTRACT

A method of ion mapping is disclosed comprising depositing a sample onto a target surface and separating the sample on the target surface according to a first physico-chemical property in a first dimension and according to a second physico-chemical property in a second dimension. The method further comprises ionizing and mass analyzing multiple separate regions of the sample so as to generate an ion map of at least a portion of the sample deposited upon the target surface. The sample is deposited onto and separated on the target surface by mechanical, hydrodynamic and/or aerodynamic means.

15 Claims, 4 Drawing Sheets

(56) References Cited

U.S. PATENT DOCUMENTS

| | | | | |
|---|---|---|---|---|
| 2003/0119063 | A1 | 6/2003 | Pham | |
| 2004/0003430 | A1* | 1/2004 | Hauptmann | C12N 15/825 800/282 |
| 2004/0018519 | A1 | 1/2004 | Wright , Jr. | |
| 2004/0033591 | A1 | 2/2004 | Lubman et al. | |
| 2005/0269267 | A1* | 12/2005 | Patton | C07K 1/26 210/656 |
| 2005/0282289 | A1 | 12/2005 | Ookubo et al. | |
| 2007/0187243 | A1* | 8/2007 | Patton | C07K 1/26 204/450 |
| 2009/0272890 | A1* | 11/2009 | Ogawa | H01J 49/061 250/281 |
| 2010/0170852 | A1* | 7/2010 | Suh | B01J 20/286 210/656 |
| 2013/0095089 | A1* | 4/2013 | Larsen | A61K 31/40 424/94.1 |

FOREIGN PATENT DOCUMENTS

| | | |
|---|---|---|
| WO | 2004/111634 | 12/2004 |
| WO | 2007058893 | 5/2007 |

* cited by examiner

TWO-DIMENSIONAL SEPARATION AND IMAGING TECHNIQUE FOR THE RAPID ANALYSIS OF BIOLOGICAL SAMPLES

CROSS-REFERENCE TO RELATED APPLICATION

This application claims priority from and the benefit of United Kingdom patent application No. 1422421.6 filed on 17 Dec. 2014 and European patent application No. 14198413.8 filed on 17 Dec. 2014. The entire contents of these applications are incorporated herein by reference.

FIELD OF THE INVENTION

The present invention relates to a method of ion mapping, a method of mass spectrometry, apparatus and a mass spectrometer.

BACKGROUND

It is known to attempt to analyse complex biological samples (such as proteins) by Matrix Assisted Laser Desorption Ionisation ("MALDI") mass spectrometry. However, the complex biological sample first needs to undergo sample preparation followed by chromatographic separation such as thin layer chromatography ("TLC") or gel electrophoresis prior to MALDI analysis. Such chromatographic separation processes are relatively time consuming and the known approaches also suffer from the serious problem that the chromatographic separations are performed using a chromatographic substrate having a surface which is not ideally suited for subsequent Matrix Assisted Laser Desorption Ionisation ("MALDI") mass spectrometry analysis.

U.S. Pat. No. 6,579,719 (Hutchens) discloses various methods of retentate chromatography. Analytes are separated in at least two non-spatial dimensions based on their ability to be adsorbed to a stationary phase under at least two different selectivity conditions (i.e. by variation of the adsorbent and eluent). The analytes may then be analysed by MALDI mass spectrometry. A plurality of different adsorbents on a single substrate are disclosed that form an array with addressable locations. The substrate may also be in the form of a strip or plate in which one or more binding characteristics may vary in a one- or two-dimensional gradient. To provide a multidimensional analysis, each adsorbent location is washed with at least a first and a second different eluent. FIG. 11 of U.S. Pat. No. 6,579,719 (Hutchens), for example, shows a composite retention map of preterm infant urine exposed to selectivity conditions defined by six different adsorbents and three different eluents.

WO 2007/058893 (Patton) discloses a method for separating a sample that includes subjecting a sample to a planar electrochromatographic separation in a selected direction and subjecting the sample to a thin-layer chromatographic separation in another direction. WO 2007/058893 (Patton) is concerned with separating samples using a combination of electrically driven planar chromatography (PEC) and thin-layer chromatography (TLC) which is optionally followed by direct detection of analytes using mass spectrometry. A sample is loaded on a planar stationary phase and an electrical field is applied to cause a first liquid mobile phase and/or the sample to advance across the length of the stationary phase, thereby separating biomolecules. A second separation that is chromatographically-based is then applied, so as to cause a second liquid mobile phase to advance across the length of the stationary phase in a second direction, thereby separating biomolecules. Typically, the second direction is perpendicular to the first direction.

A problem with the arrangements disclosed in both U.S. Pat. No. 6,579,719 (Hutchens) and WO 2007/058893 (Patton) is that the chromatographic separation processes are relatively slow and the surface of the chromatographic substrate is not ideally suited for subsequent MALDI analysis.

It is desired to provide an improved method of mass spectrometry.

SUMMARY

According to an aspect there is provided a method of ion mapping comprising:

depositing a sample onto a target surface;

separating the sample on the target surface according to a first physico-chemical property in a first dimension and according to a second physico-chemical property in a second dimension; and ionising and mass analysing multiple separate regions of the sample so as to generate an ion map of at least a portion of the sample deposited upon the target surface;

wherein the sample is deposited onto and separated on the target surface by mechanical, hydrodynamic and/or aerodynamic means.

The approach according to various embodiments is particularly advantageous in that the method of depositing and separating the sample on to the target is quick and simple and furthermore the sample can be deposited onto a target which is particularly suitable for subsequent MALDI analysis. This is in contrast to conventional arrangements.

The first and second physico-chemical properties may be the same or different.

According to various embodiments a sample is deposited onto and separated on a target surface in two dimensions by mechanical, hydrodynamic and/or aerodynamic means.

It is known to separate a sample in two dimensions on a surface using conventional chromatographic techniques. For example, WO 2007/058893 (Patton) discloses a method for separating a sample that includes subjecting a sample to a planar electrochromatographic separation in a selected direction and then subjecting the sample to a thin-layer chromatographic separation in another direction. However, this approach does not use mechanical, hydrodynamic and/or aerodynamic means within the meaning of the present invention to deposit the sample on a target and then to effect a two-dimensional separation of the sample on the target surface.

The known approach is relatively time consuming and the separations are provided on a chromatography substrate surface which is not ideally suited for subsequent Matrix Assisted Laser Desorption Ionisation ("MALDI") mass spectrometry analysis.

By way of contrast, the present embodiments advantageously provide a simple and quick two dimensional separation of a sample on a target surface using mechanical, hydrodynamic and/or aerodynamic means. This enables a subsequent method of ion mapping to be performed that is free of complex procedures. Furthermore, the subsequent ion mapping analysis can be performed on a surface that is substantially optimised for Matrix Assisted Laser Desorption Ionisation ("MALDI") or other similar forms of mass spectrometry analysis.

The steps of depositing and separating the sample on the target may comprise depositing the sample onto the target surface such that the sample separates according to a first physico-chemical property in a first dimension and according to a second physico-chemical property in a second dimension.

The first and second physico-chemical properties may be the same or different.

Alternatively, the steps of depositing and separating the sample may comprise depositing the sample onto the target surface and then separating the sample on the target surface according to a first physico-chemical property in a first dimension and according to a second physico-chemical property in a second dimension.

Alternatively, the steps of depositing and separating the sample may comprise depositing the sample onto the target surface such that the sample separates according to a first physico-chemical property in a first dimension and according to a second physico-chemical property in a second dimension and then optionally further separating the sample on the target surface according to a third physico-chemical property in a third dimension and optionally according to a fourth physico-chemical property in a fourth dimension.

The first dimension may be orthogonal to the second dimension.

The first dimension may comprise a first spatial dimension and the second dimension may comprise a second spatial dimension.

The sample may comprise a liquid sample.

The sample may be dissolved in a liquid solvent.

The method may further comprise applying a liquid solvent to the sample on the target surface.

According to an embodiment, the target surface may comprise a substantially non-porous and/or substantially even target surface. The sample may be deposited onto a non-porous target surface and separated in two dimensions.

It is known to separate a sample in two dimensions on a porous surface using conventional chromatographic techniques. For example, WO 2007/058893 (Patton) discloses a method for separating a sample that includes subjecting a sample to a planar electrochromatographic separation in a selected direction and subjecting the sample to a thin-layer chromatographic separation in another direction.

However, the known approach is performed on porous and uneven chromatography substrate surfaces which leads to mass spectral peak broadening and degradation of mass accuracy when combined with axial Time of Flight mass analysis.

Furthermore, the known approach is time consuming and provides separation on chromatography substrate surfaces that are not ideally suited for subsequent Matrix Assisted Laser Desorption Ionisation ("MALDI") mass spectrometry analysis.

In contrast, the present embodiments advantageously provide separations on a non-porous surface and as such, provide a method of ion mapping that has improved mass accuracy, is free of complex procedures and which may be performed on a surface that is optimised for Matrix Assisted Laser Desorption Ionisation ("MALDI") or other related mass spectrometry analysis.

The target surface may comprise a metallic target surface.

The target surface may comprise a polished metallic target surface.

The target surface may comprise a stainless steel target surface.

Other embodiments are also contemplated wherein the target may comprise a semiconductor target or an insulator target.

According to an embodiment the target may further comprise one or more elongated grooves for guiding a sample deposited upon the target surface.

The target may comprise a plate.

Alternatively, the target may comprise a rod.

The steps of depositing and separating the sample may further comprise depositing the sample onto the target surface using a nebuliser.

The steps of depositing and separating the sample may further comprise depositing the sample onto the target surface using a sample syringe or sample spotter.

The steps of depositing and separating the sample may further comprise introducing a sample into a gas spray and impacting the spray upon the target surface.

The steps of depositing and separating the sample may further comprise forcing a sample deposited onto the target surface to traverse along the target surface under the influence of a gas and/or liquid flow.

The liquid flow may comprise a liquid solvent flow.

The steps of depositing and separating the sample may further comprise dispersing a sample deposited onto the target surface along the target surface under the influence of gravity.

The steps of depositing and separating the sample may further comprise spreading a sample deposited onto the target surface optionally using a blade or other device.

The steps of depositing and separating the sample may further comprise heating the sample and/or the target.

The steps of depositing and separating the sample may further comprise translating, moving, rotating, vibrating and/or agitating the target.

The mechanical, hydrodynamic and/or aerodynamic means may comprise a nebuliser to deposit the sample onto the target surface.

The mechanical, hydrodynamic and/or aerodynamic means may further comprise a sample syringe or sample spotter to deposit the sample onto the target surface.

The mechanical, hydrodynamic and/or aerodynamic means may further comprise a device arranged and adapted to introduce a sample into a gas spray and impact the spray upon the target surface.

The mechanical, hydrodynamic and/or aerodynamic means may further comprise a device arranged and adapted to force a sample deposited onto the target surface to traverse along the target surface under the influence of a gas and/or liquid flow.

The mechanical, hydrodynamic and/or aerodynamic means may further comprise a device arranged and adapted to disperse a sample deposited onto the target surface along the target surface under the influence of gravity.

The mechanical, hydrodynamic and/or aerodynamic means may further comprise a device arranged and adapted to spread a sample deposited onto the target surface optionally using a blade or other device.

The mechanical, hydrodynamic and/or aerodynamic means may further comprise a device arranged and adapted to heat the sample and/or the target.

The mechanical, hydrodynamic and/or aerodynamic means further comprise a device arranged and adapted to translate, move, rotate, vibrate and/or agitate the target.

According to an embodiment the target comprises a rod covered with one or more sheets and wherein after the steps of depositing and separating the sample, the method further comprises transferring the one or more sheets to a second target.

The step of ionising and mass analysing multiple separate regions of the sample so as to generate an ion map of at least a portion of the sample deposited upon the target surface may be performed upon the one or more sheets which have been transferred to the second target.

According to an embodiment cells in biological samples that either bind to the target or move along the target surface may undergo cell lysis under the extreme conditions of turbulence, microvorticity and sonication etc. Accordingly, lysed contents of the cell would then be separated according to a physico-chemical property in a first dimension.

The second target may comprise a planar target.

The method may further comprise applying a matrix to the sample prior to ionising and mass analysing the sample.

The method may further comprise maintaining an electric field across at least a portion of the sample in order to cause at least some portions of the sample to separate by electromigration.

The method may further comprise ionising one or more regions of the sample using a Matrix Assisted Laser Desorption Ionization ("MALDI") ion source.

The method may further comprise ionising one or more regions of the sample using a Fast Atom Bombardment ("FAB") ion source.

The method may further comprise ionising one or more regions of the sample using a Surface Assisted Laser Desorption Ionisation ("SALDI") ion source.

The method may further comprise ionising one or more regions of the sample using a Desorption Electrospray Ionisation ("DESI") ion source.

The first physico-chemical property and/or the second physico-chemical property may comprise mass, mass to charge ratio, ion mobility, diffusivity, interaction cross section, surface bonding, surface affinity, liquid surface affinity, solubility, solution solubility, ion pairing affinity, binding affinity or polarity.

According to another aspect there is provided a method of mass spectrometry comprising a method as described above.

According to another aspect there is provided apparatus comprising:

a target;

a first device arranged and adapted to deposit a sample onto the surface of the target and to separate the sample on the target surface according to a first physico-chemical property in a first dimension and according to a second physico-chemical property in a second dimension by mechanical, hydrodynamic and/or aerodynamic means; and a second device arranged and adapted to ionise and mass analyse multiple separate regions of the sample so as to generate an ion map of at least a portion of the sample deposited upon the target surface.

According to another aspect there is provided a mass spectrometer comprising apparatus as described above.

Although the various embodiment relate to a method of ion mapping, other embodiments are also contemplated wherein the method relates more generally to generating a map of a sample and wherein the sample is analysed using imaging techniques such as chemical staining, UV illumination or absorption techniques.

According to another aspect there is provided a method of mapping a sample comprising:

depositing a sample onto a target surface;

separating the sample on the target surface according to a first physico-chemical property in a first dimension and according to a second physico-chemical property in a second dimension; and analysing multiple separate regions of the sample so as to generate a map of at least a portion of the sample deposited upon the target surface;

wherein the sample is deposited onto and separated on the target surface by mechanical, hydrodynamic and/or aerodynamic means.

According to another aspect there is provided apparatus comprising:

a target;

a first device arranged and adapted to deposit a sample onto the surface of the target and to separate the sample on the target surface according to a first physico-chemical property in a first dimension and according to a second physico-chemical property in a second dimension by mechanical, hydrodynamic and/or aerodynamic means; and a second device arranged and adapted to analyse multiple separate regions of the sample so as to generate a map of at least a portion of the sample deposited upon the target surface.

The various embodiments provide an extremely rapid pseudo separation on a surface which may be optimal for MALDI mass spectrometry imaging.

According to an embodiment complex biological samples may be deposited onto a metallic surface whereupon they undergo a rapid two dimensional pseudo separation by, for example, entirely mechanical, hydrodynamic and/or aerodynamic means, e.g. without requiring the application of an electric field. The resulting separations may then be analysed directly using Matrix Assisted Laser Desorption Ionisation ("MALDI") mass spectrometry imaging.

Although the various embodiments relate to a method wherein a sample is deposited onto a target surface, other embodiments are also contemplated wherein a sample is already present on a target surface (i.e. is provided on a target surface) and the sample is separated on the target surface.

According to another aspect there is provided a method of ion mapping comprising:

providing a sample on a target surface;

separating the sample on the target surface according to a first physico-chemical property in a first dimension and according to a second physico-chemical property in a second dimension; and ionising and mass analysing multiple separate regions of the sample so as to generate an ion map of at least a portion of the sample on the target surface;

wherein the sample is separated on the target surface by mechanical, hydrodynamic and/or aerodynamic means.

The method may further comprise applying a liquid solvent to the sample on the target surface.

According to another aspect there is provided apparatus comprising:

a target;

a first device arranged and adapted to separate a sample provided on a surface of the target according to a first physico-chemical property in a first dimension and according to a second physico-chemical property in a second dimension by mechanical, hydrodynamic and/or aerodynamic means; and a second device arranged and adapted to ionise and mass analyse multiple separate regions of the sample so as to generate an ion map of at least a portion of the sample on the surface of the target.

According to an aspect there is provided a method of ion mapping comprising:

separating a sample onto or on a target surface according to one or more first physico-chemical properties in a first dimension and according to one or more second physico-chemical properties in a second dimension by mechanical, hydrodynamic and/or aerodynamic means; and ionising and mass analysing multiple separate regions of the sample so as to generate an ion map of at least a portion of the sample on the target surface.

The approach according to various embodiments is particularly advantageous in that the method of separating the sample onto or on the target is quick and simple and furthermore the sample can be separated onto or on a target which is particularly suitable for subsequent MALDI analysis. This is in contrast to conventional arrangements.

The one or more first physico-chemical properties and the one or more second physico-chemical properties may be the same or different.

According to another aspect there is provided apparatus comprising:

a target;

a first device arranged and adapted to separate a sample onto or on a surface of the target according to one or more first physico-chemical properties in a first dimension and according to one or more second physico-chemical properties in a second dimension by mechanical, hydrodynamic and/or aerodynamic means; and a second device arranged and adapted to ionise and mass analyse multiple separate regions of the sample so as to generate an ion map of at least a portion of the sample on the surface of the target.

According to an aspect there is provided a method of ion mapping comprising:

depositing a sample onto a target such that the sample separates according to a physico-chemical property in a first dimension and according to a physico-chemical property in a second preferably orthogonal dimension; and ionising and mass analysing multiple separate regions of the sample so as to generate an ion map of at least a portion of the sample deposited upon the target.

The target may comprise a metallic target. However, other embodiments are also contemplated wherein the target comprises a semiconductor target or an insulator target.

According to an embodiment the target may further comprise one or more elongated grooves for guiding a sample deposited upon the target.

The method may further comprise depositing the sample onto the target using a nebuliser.

The method may further comprise depositing the sample onto the target using a sample syringe or sample spotter.

The target may comprise a plate.

Alternatively, the target may comprise a rod.

The method may further comprise spreading a sample deposited onto the target may using a blade or other device.

The method may further comprise heating the sample and/or the target.

The method may further comprise translating, moving, rotating, vibrating or agitating the target.

According to an embodiment the target comprises a rod covered with one or more sheets and wherein after the step of depositing the sample onto the rod target such that the sample separates according to a physico-chemical property in a first dimension and according to a physico-chemical property in a second dimension that may be orthogonal to the first dimension, the method further comprises transferring the one or more sheets to a second target.

The step of ionising and mass analysing multiple separate regions of the sample so as to generate an ion map of at least a portion of the sample deposited upon the target is may performed upon the one or one sheets which have been transferred to the second target.

According to an embodiment cells in biological samples that either bind to the target or move along the target surface may undergo cell lysis under the extreme conditions of turbulence, microvorticity and sonication etc. Accordingly, lysed contents of the cell would then may be separated according to a physico-chemical property in a first dimension.

The second target may comprise a planar target.

The method may further comprise applying a matrix to the sample prior to ionising and mass analysing the sample.

The method may further comprise maintaining an electric field across at least a portion of the sample in order to cause at least some portions of the sample to separate by electromigration.

The method may further comprise ionising one or more regions of the sample using a Matrix Assisted Laser Desorption Ionization ("MALDI") ion source.

The method may further comprise ionising one or more regions of the sample using a Fast Atom Bombardment ("FAB") ion source.

The method may further comprise ionising one or more regions of the sample using a Surface Assisted Laser Desorption Ionisation ("SALDI") ion source.

The method may further comprise ionising one or more regions of the sample using a Desorption Electrospray Ionisation ("DESI") ion source.

The physico-chemical property may comprise mass, mass to charge ratio, ion mobility, diffusivity, interaction cross section, surface bonding, surface affinity, liquid surface affinity, solubility, solution solubility, ion pairing affinity, binding affinity or polarity.

According to another aspect there is provided a method of mass spectrometry comprising a method as described above.

According to another aspect there is provided apparatus comprising:

a target;

a first device arranged and adapted to deposit a sample onto the target such that the sample separates according to a physico-chemical property in a first dimension and according to a physico-chemical property in a second may orthogonal dimension; and a second device arranged and adapted to ionise and mass analyse multiple separate regions of the sample so as to generate an ion map of at least a portion of the sample deposited upon the target.

According to another aspect there is provided a mass spectrometer comprising apparatus as described above.

Although the various embodiments relate to a method of ion mapping, other embodiments are also contemplated wherein the method relates more generally to generating a map of a sample and wherein the sample is analysed using imaging techniques such as chemical staining, UV illumination or absorption techniques.

According to another aspect there is provided a method of mapping a sample comprising:

depositing a sample onto a target such that the sample separates according to a physico-chemical property in a first dimension and according to a physico-chemical property in a second may orthogonal dimension; and analysing multiple separate regions of the sample so as to generate a map of at least a portion of the sample deposited upon the target.

According to another aspect there is provided apparatus comprising:

a target;

a first device arranged and adapted to deposit a sample onto the target such that the sample separates according to a physico-chemical property in a first dimension and according to a physico-chemical property in a second may orthogonal dimension; and a second device arranged and adapted to analyse multiple separate regions of the sample so as to generate a map of at least a portion of the sample deposited upon the target.

The spectrometer may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source.

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

A chromatography detector may be provided, wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Figure 1:
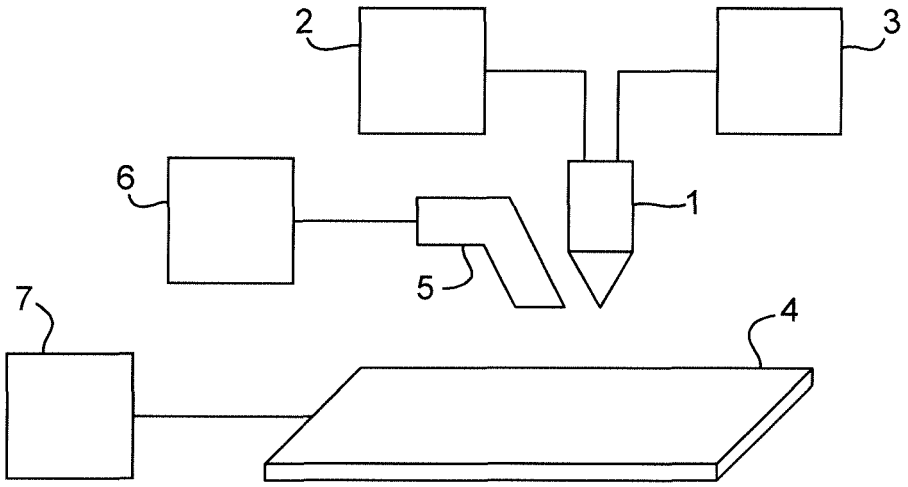
FIG. 1 shows an embodiment wherein a sample is deposited onto a metallic target plate using a nebuliser and wherein the sample undergoes a two dimensional separation.

Matrix Assisted Laser Desorption Ionization ("MALDI") mass spectrometry analysis of complex samples such as blood or urine usually incorporates a time consuming sample preparation stage wherein the sample is subjected to processes such as dilution, desalting and protein precipitation prior to sample spotting, matrix application and subsequent mass spectrometry analysis.

In an attempt to increase the specificity and simplicity of this process it is known to combine two dimensional ("2D") separation techniques such as thin layer chromatography ("TLC") with MALDI mass spectrometry analysis. For example, it is known to cut two dimensional fractions from a thin layer chromatography substrate diluted in an appropriate solvent and then subject the sample to LC/MS analysis.

It is known that MALDI/MS data can be obtained directly from the thin layer chromatography plates following the application of a suitable matrix coating. This improves the speed of analysis. However, disadvantageously the porous and uneven surface of the thin layer chromatography substrate leads to mass spectral peak broadening and degradation of mass accuracy when combined with axial Time of Flight mass analysis.

From a clinical diagnostic perspective it would be advantageous to further simplify the sample preparation process for complex biological samples. In order to be suitable for point of care medical diagnostics, a sample preparation technique is desired that is fast, free of complex procedures, uses non-toxic reagents and deposits samples on media that are optimal for subsequent Matrix Assisted Laser Desorption Ionization mass spectrometry imaging experiments.

Various embodiments relate to an apparatus and method that combines a two dimensional spatial separation of sample components on a target which is suitable for subsequent Matrix Assisted Laser Desorption Ionization mass spectrometry imaging thereby allowing rapid analysis of complex samples with enhanced specificity.

Various techniques may be used to effect a pseudo spatial separation of components in a complex sample by the use of mechanical, hydrodynamic and/or aerodynamic means in accordance with various embodiments. For example, according to an embodiment a sample may be introduced into a high gas velocity spray which may then be directed at a metallic target. This process involves droplet break-up, surface turbulence/microvorticity, liquid deposition and surface liquid striation. Spatial separation of various components will occur due to their physicochemical properties such as surface affinity and solution solubility etc.

This form of separation may be observed with a number of physical arrangements including, but not limited to: (i) a pneumatically nebulised spray impacting upon a static or moving target; (ii) a pneumatically nebulised spray impacting on a cylindrical target in a cross flow arrangement; (iii) a spotted liquid sample that is forced to traverse along a target surface under the influence of a gas flow; (iv) a spotted liquid sample that is compelled to disperse along an inclined target under the influence of ultrasonic agitation; or (v) a spotted liquid sample that is compelled to disperse along a rod target under the influence of a high axial frequency of rotation.

In these examples analyte separation depends upon a basic affinity for the two phases (i.e. the solid or liquid phase) and may be influenced by physicochemical properties such as surface bonding, liquid surface affinity, solubility and ion pairing affinity. Samples may be dissolved in liquids that include but are not limited to reverse phase chromatographic solvents such as water, methanol, acetonitrile and normal phase solvents such as hexane, chloroform or any mixtures of such solvents.

Various embodiments relate to a method of ion mapping comprising depositing a sample onto a target surface and separating the sample on the target surface according to a first physico-chemical property in a first dimension and according to a second physico-chemical property in a second dimension. The method further comprises ionising and mass analysing multiple separate regions of the sample so as to generate an ion map of at least a portion of the sample deposited upon the target surface. According to various embodiments the sample is deposited onto and separated on the target surface by mechanical, hydrodynamic and/or aerodynamic means.

The approach according to various embodiments is particularly advantageous in that the method of depositing and separating the sample on to the target is quick and simple and furthermore the sample can be deposited onto a target which is particularly suitable for subsequent MALDI analysis. This is in contrast to conventional arrangements.

The first and second physico-chemical properties may be the same or different.

According to various embodiments a sample may be deposited onto and separated in two dimensions on a target surface. The separation of the sample may occur, for example, before the sample is in contact with the target surface, as the sample makes contact with the target surface and/or after the sample has made contact with the target surface.

According to various embodiments the sample may be deposited and separated by various mechanical, hydrodynamic and/or aerodynamic means. In other words, the method may comprise providing mechanical, hydrodynamic and/or aerodynamic means for depositing and separating the sample and/or causing the sample to be deposited and separated on the target surface by the mechanical, hydrodynamic and/or aerodynamic means. This is in contrast to conventional arrangements wherein a sample is separated by chromatographic means.

For example, according to various embodiments depositing and separating the sample may comprise one or more of the following (the sample may be deposited and separated by mechanical, hydrodynamic and/or aerodynamic means for): (i) introducing the sample into a gas spray and impacting the spray upon the target surface; (ii) forcing the sample to traverse along the target surface under the influence of a gas and/or liquid flow; (iii) dispersing the sample along the target surface under the influence of gravity; (iv) spreading the sample on the target surface optionally using a blade or other device; (v) heating the sample and/or the target; and/or (vi) translating, moving, rotating, vibrating and/or agitating the target.

Spatial separation of various components of the sample will occur according to their one or more physico-chemical properties in two dimensions, such as mass, mass to charge ratio, ion mobility, diffusivity, interaction cross section, surface bonding, surface affinity, liquid surface affinity, solubility, solution solubility, ion pairing affinity, binding affinity, polarity, other physico-chemical properties and any combination thereof.

According to various embodiments multiple separate regions of the sample may be ionised and mass analysed so as to generate an ion map (i.e. a mass spectrometry image) of at least a portion of the sample on the target surface.

According to various embodiments the steps of depositing and separating the sample may further comprise depositing the sample onto the target surface such that the sample separates according to the first physico-chemical property in the first dimension and according to the second physico-chemical property in the second dimension by mechanical, hydrodynamic and/or aerodynamic means. The sample may be deposited onto the target surface in such a way that the sample is caused to separate onto the target surface in two dimensions.

For example, according to an embodiment a sample may be introduced into a gas spray which may then be impacted upon a target surface. This process involves droplet break-up, surface turbulence/microvorticity, liquid deposition and surface liquid striation. Spatial separation of various components of the sample will occur according to their one or more physico-chemical properties, such as surface affinity and solution solubility etc.

According to various embodiments, the sample may be deposited onto the target surface before the separation begins. For example, in an embodiment urine or blood samples are deposited on the target surface before being separated in two dimensions on the target surface.

According to various embodiments the first dimension may be orthogonal to the second dimension and optionally the first dimension may comprise a first spatial dimension and the second dimension may comprise a second spatial dimension. The sample may be separated in two spatial dimensions which are optionally orthogonal to each other.

The sample may be a liquid sample. For example, in an embodiment the sample may comprise blood, urine or any other liquid sample. Additionally or alternatively, the sample may be dissolved in a liquid solvent, such as reverse phase chromatographic solvents such as water, methanol, acetonitrile and normal phase solvents such as hexane, chloroform or any mixtures of such solvents. A liquid solvent may also be applied to the sample on the target surface, in which case the sample may then be dissolved in the liquid solvent that has been applied to the sample on the target surface. As will be appreciated, the sample need not be a liquid sample.

The target surface may be substantially non-porous and/or substantially even such that a separation is provided on a target surface that is suited for subsequent Matrix Assisted Laser Desorption Ionisation ("MALDI") mass spectrometry analysis. For example, in embodiments, the target surface comprises a metallic target surface, a polished metallic target surface, a stainless steel target surface or a polished stainless steel target surface.

In various embodiments, the sample may already be present on (i.e. provided on) the target surface before the separation begins. For example, in an embodiment fingerprints or blood speckles are provided on the target surface before being separated in two dimensions on the target surface. The fingerprints or blood speckles may be dissolved by a solvent applied to the target surface before being separated in two dimensions on the target surface.

In various embodiments, a sample may be separated onto or on a target surface according to one or more first physico-chemical properties in a first dimension and according to one or more second physico-chemical properties in a second dimension by mechanical, hydrodynamic and/or aerodynamic means. The one or more first physico-chemical properties and the one or more second physico-chemical properties may be the same or different.

The sample may be separated, for example, by introducing the sample into a gas spray and impacting the spray upon the target surface, forcing the sample to traverse along the target surface under the influence of a gas and/or liquid flow, dispersing the sample along the target surface under the influence of gravity, spreading the sample on the target surface optionally using a blade or other device, heating the sample and/or the target, translating, moving, rotating, vibrating and/or agitating the target.

The one or more first physico-chemical properties and/or the one or more second physico-chemical properties may comprise mass, mass to charge ratio, ion mobility, diffusivity, interaction cross section, surface bonding, surface affinity, liquid surface affinity, solubility, solution solubility, ion pairing affinity, binding affinity and/or polarity.

According to various embodiments a sample is separated onto or on a metallic target surface according to one or more first physico-chemical properties in a first dimension and according to one or more second physico-chemical properties in a second dimension.

Various embodiments will now be described in more detail.

FIG. 1 shows an embodiment wherein apparatus is provided to effect a two dimensional separation of a complex sample. A liquid sample is infused into a nebuliser 1 via a solvent delivery pump 2. The liquid flow is then atomized by a high velocity gas flow which is produced from a pressurized gas supply 3. The atomized spray is then arranged to impact upon a target 4 which comprises a polished stainless steel plate. The pump 2 may comprise a syringe infusion pump or other pump that may include an injection port for admitting a small amount of the liquid sample into the apparatus.

The nebuliser 1 shown in FIG. 1 is in a vertical position. However, according to other embodiments the nebuliser 1 may be inclined at an angle between 0-90° with respect to the target plate 4.

A heater 5 may be provided and may be powered by a heater power supply 6 so as to indirectly heat the target plate 4 and/or the spray in order to dry the sample as it disperses under the influence of the nebuliser gas flow onto the target plate 4. The heater 5 may also have an independent gas flow or may comprise a radiative type such as an infrared (IR) lamp. During the sample deposition process the target plate 4 may either be kept static with respect to the nebuliser 1 or alternatively the target plate 4 may be moved in any direction by a target plate translator 7.

According to this embodiment the sample is deposited onto the target surface by mechanical, hydrodynamic and/or aerodynamic means. The target comprises a plate, the sample is introduced into a gas spray and the spray impacted upon the target surface, the sample and the target are heated, and the target may be translated and/or moved. The sample which is deposited upon the target surface will separate in a first dimension or direction according to a first physico-chemical property and will separate in a second dimension or direction according to a second physico-chemical property so that a two-dimensional separation is achieved. The first and second physico-chemical properties may be the same or different.

Figure 2:
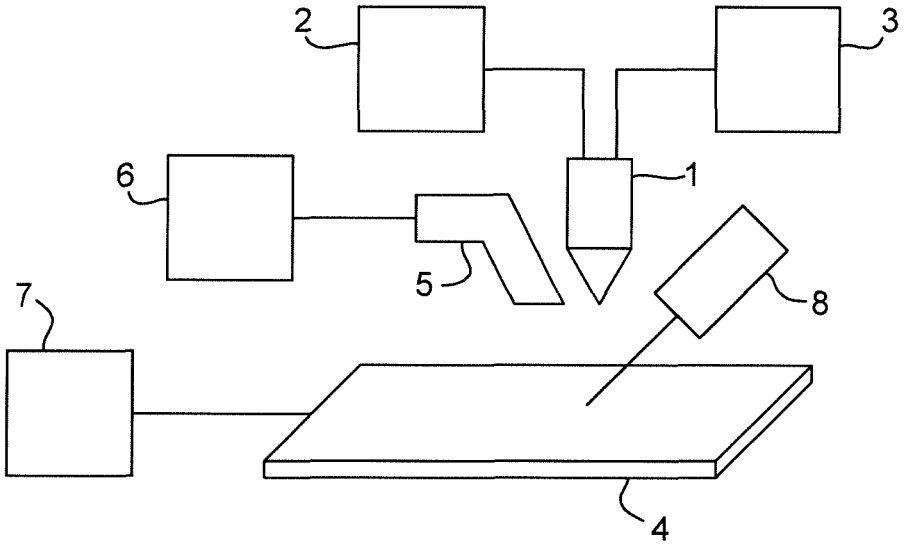
FIG. 2 shows an embodiment wherein a sample spotter is used to deposit a sample onto a metallic target plate and wherein the sample then undergoes a two dimensional separation.

FIG. 2 shows an embodiment wherein a sample is directly spotted onto a target plate 4 in the form of a discrete droplet, a number of droplets or as a line of liquid. The sample is deposited via a sample syringe 8 or sample spotter and may be initially deposited in the presence or absence of gas or liquid flow from a nebuliser 1. The sample may be spotted and the nebuliser gas may then be applied with no liquid flow from the nebuliser 1. Under these conditions the sample disperses in the form of rolling droplets or elongated liquid striations. Alternatively, the sample may be spotted prior to the commencement of a ballistic (fast) solvent gradient from the solvent delivery pump 2 in either a static or moving target mode. All other experimental parameters are as described above in relation to the embodiment shown and described above with reference to FIG. 1.

According to this embodiment the sample is deposited onto the target surface by mechanical, hydrodynamic and/or aerodynamic means. The sample is forced to traverse along the target surface under the influence of a gas and/or liquid flow. The sample which is deposited upon the target surface will separate in a first dimension or direction according to a first physico-chemical property and will separate in a second dimension or direction according to a second physico-chemical property so that a two-dimensional separation is achieved. The first and second physico-chemical properties may be the same or different.

Figure 3:
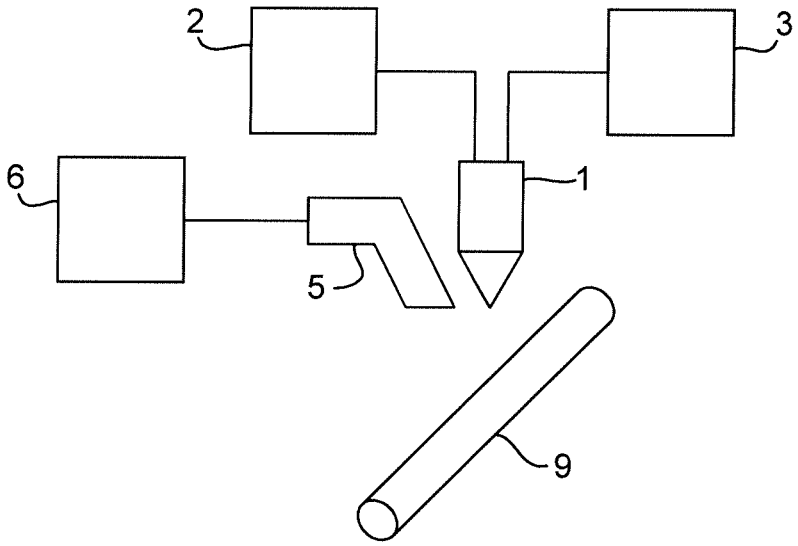
FIG. 3 shows an embodiment wherein the target comprises a cylindrical rod.

FIG. 3 shows an alternative embodiment wherein the target plate has been replaced with a cylindrical rod target 9. The cylindrical rod 9 is positioned perpendicular to the flow of gas from the nebuliser 1. This embodiment comprises a cross flow arrangement which produces counter-rotating surface vortices which are aligned in the direction of the gas flow. The surface microvortices exhibit mass dependent deposition effects that enable a two dimensional separation to be obtained of complex sample components entrained in the atomized spray from the nebuliser 1. According to another embodiment a liquid sample may be spotted onto the cylindrical rod target 9 in the absence or presence of a nebuliser liquid flow.

According to this embodiment the sample is deposited onto the target surface by mechanical, hydrodynamic and/or aerodynamic means. The target comprises a rod, the sample is introduced into a gas spray and the spray is impacted upon the target surface. The sample which is deposited upon the target surface will separate in a first dimension or direction according to a first physico-chemical property and will separate in a second dimension or direction according to a second physico-chemical property so that a two-dimensional separation is achieved. The first and second physico-chemical properties may be the same or different.

Figure 4:
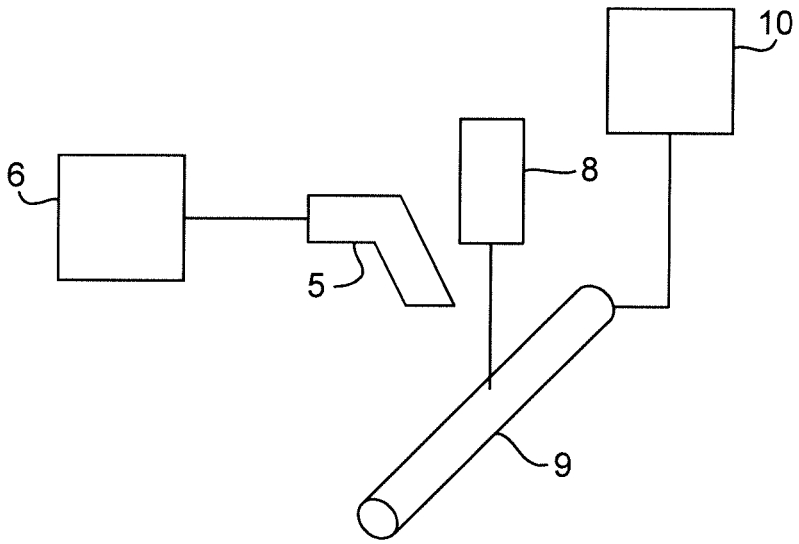
FIG. 4 shows an embodiment wherein a liquid sample is spotted onto a cylindrical rod target via a syringe.

FIG. 4 shows another embodiment wherein a liquid sample is spotted onto the cylindrical rod target 9 via a sample syringe 8. The cylindrical target 9 is then rapidly rotated about its axis via a motor 10 that is capable of rotational speeds in the range of e.g. 10-10000 rpm. In the case of a horizontally aligned target 9 the liquid sample is dispersed longitudinally along the axis of rotation and in both directions from the initial point of deposition. Heat may be applied during this process from a heater 5 that may include a flow of drying gas.

According to this embodiment the sample is deposited onto the target surface by mechanical, hydrodynamic and/or aerodynamic means. The target comprises a rod which is rotated. The sample which is deposited upon the target surface will separate in a first dimension or direction according to a first physico-chemical property and will separate in a second dimension or direction according to a second physico-chemical property so that a two-dimensional separation is achieved. The first and second physico-chemical properties may be the same or different.

Figure 5:
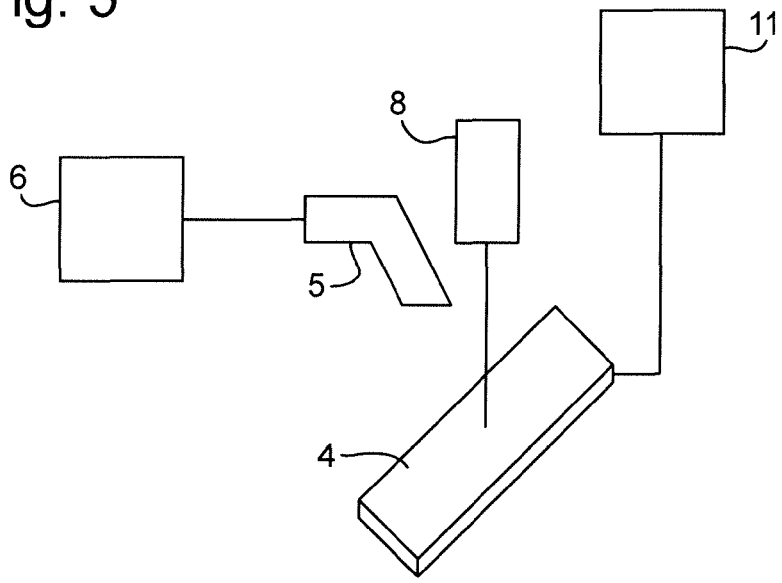
FIG. 5 shows an alternative embodiment wherein a liquid sample is spotted onto an inclined target plate and wherein the target plate is then ultrasonically agitated.

FIG. 5 shows an alternative embodiment wherein a liquid sample is spotted from a syringe 8 onto an inclined target plate 4. The inclined target plate 4 is agitated at e.g. ultrasonic frequencies (e.g. kHz to GHz) via a transducer 11. The liquid sample is dispersed along the target plate 4 as the gravitational and ultrasonic forces overcome the surface tension of the initially deposited sample droplet. Heat may be applied during this process from a heater 5 that may include a flow of drying gas.

According to this embodiment the sample is deposited onto the target surface by mechanical, hydrodynamic and/or aerodynamic means. The sample is dispersed along the target surface under the influence of gravity and the target is vibrated and agitated. The sample which is deposited upon the target surface will separate in a first dimension or direction according to a first physico-chemical property and will separate in a second dimension or direction according to a second physico-chemical property so that a two-dimensional separation is achieved. The first and second physico-chemical properties may be the same or different.

Figure 6:
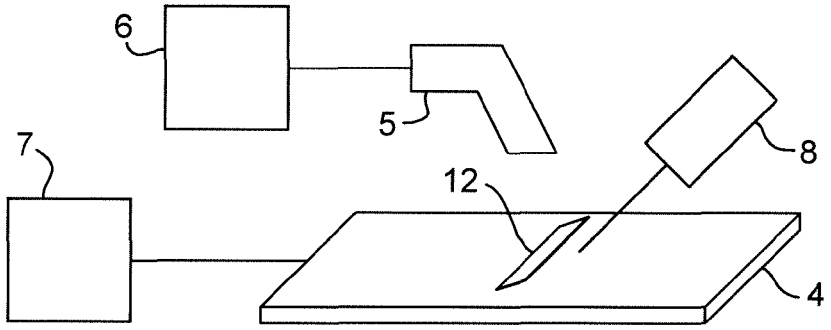
FIG. 6 shows an embodiment wherein a blade is used to smear a sample liquid which has been deposited onto a target plate.

FIG. 6 shows an alternative embodiment wherein a liquid sample is spotted from a syringe 8 onto a planar target 4. A blade 12 is positioned so as to contact the target surface or at least approach to a point such that the gap between the blade 12 and the planar target 4 is significantly less than the height of the initial sample droplet or droplets. A target translator 7 is used to move the droplet against the blade 12 such that the liquid is smeared along a length of the target 4. A heater 5 may be used to help evaporate the solvent during the smearing process.

According to this embodiment the sample is deposited onto the target surface by mechanical, hydrodynamic and/or aerodynamic means. The sample is spread on the target surface using a blade. The sample which is deposited upon the target surface will separate in a first dimension or direction according to a first physico-chemical property and will separate in a second dimension or direction according to a second physico-chemical property so that a two-dimensional separation is achieved. The first and second physico-chemical properties may be the same or different.

According to a further embodiment a rapid separation can be effected by spotting, for example, 2-3 μL of liquid onto a planar target and then spreading the spot over an area of typically 0.3-0.5 $cm^2$ prior to heating the liquid via a hot stream of gas (200° C., 1.5 m/s, orthogonal to the plate with a static target).

This process typically results in a series of concentric tide marks (rings) as analytes are deposited according to their solubility in the liquid whose composition will change rapidly with time. Thus for a solution of 1:1 methanol/water samples of low polarity are deposited in the outer rings whilst the polar analytes are retained in the shrinking liquid as the water concentration increases with time. Accordingly, the polar compounds are deposited in the rings that are closest to the centre of the original liquid area.

According to this embodiment the sample is deposited onto the target surface by mechanical, hydrodynamic and/or aerodynamic means. The sample is spread on the target surface and heated. The sample which is deposited upon the target surface will separate in a first dimension or direction according to a first physico-chemical property and will separate in a second dimension or direction according to a second physico-chemical property so that a two-dimensional separation is achieved. The first and second physico-chemical properties may be the same or different.

In all the embodiments described above the specificity of the two dimensional separation may be improved by: (i) chemically or physically modifying the target surface to increase or decrease its binding affinity for a particular target analyte or group of analytes; and/or (ii) modifying the chemical or physical properties of the solvent to assist in the differential separation of analytes; and/or (iii) performing the separation in the presence of an electric field in order to encourage separation based on electromigration processes.

The latter modification may be implemented, for example, by raising the potential of the target plate or rod to a high voltage whilst grounding the other components etc. According to this embodiment an electric field is maintained across at least a portion of the sample in order to cause at least some portions of the sample to separate by electromigration.

Various embodiments relate to the combination of a two dimensional sample separation combined with Matrix Assisted Laser Desorption Ionization mass spectrometry imaging for the fast analysis of complex samples such as blood or urine. In most cases, the implementation of the technique may proceed according to the stages as depicted in the flow diagram shown in FIG. 7.

The method according to various embodiments consists of a two dimensional sample separation on a target using one or more of the techniques described above. This is followed by the application of matrix material directly on to the target i.e. a matrix may be applied to the sample prior to ionising and mass analysing the sample. Matrix Assisted Laser Desorption Ionization mass spectrometry imaging of the target or a relevant section of the target is then performed and post processing (data mining) of the acquired mass spectrometry data is then subsequently performed. The matrix coating stage is not essential for obtaining mass spectrometry data from the target. Accordingly, the method is not limited to Matrix Assisted Laser Desorption Ionization mass spectrometry analysis and may be used in combination with Fast Atom Bombardment ("FAB"), Surface Assisted Laser Desorption Ionisation ("SALDI"), Desorption Electrospray Ionisation ("DESI") or other mass spectrometry ("MS") imaging techniques.

According to these various embodiments one or more regions of the sample are ionised using a Matrix Assisted Laser Desorption Ionization ("MALDI") ion source, a Fast Atom Bombardment ("FAB") ion source, a Surface Assisted Laser Desorption Ionisation ("SALDI") ion source, a Desorption Electrospray Ionisation ("DESI") ion source or any other suitable ion source.

In order to illustrate the potential utility of the present analytical technique neat urine was sprayed from a pneumatically assisted nebuliser onto a stainless steel rod which was positioned in a cross-flow arrangement substantially as shown in FIG. 3.

The nebuliser consisted of a central liquid sample capillary (stainless steel, 127 μm internal diameter, 229 μm outside diameter) and an outer gas flow capillary (stainless steel, 330 μm internal diameter). This concentric arrangement created a gas flow restriction path over a length of 25 mm beyond which a nitrogen gas reservoir was pressurized to 7 bar. In this arrangement, the nebuliser was surrounded by an annulus heater which delivered nitrogen gas at a temperature of 200° C. and at a flow rate of 1000 L/hr. The target comprised a 1.6 mm diameter polished stainless steel rod which was held approximately 3 mm from the nebuliser tip and which was positioned orthogonal to the spray axis. The urine was sprayed at a flow rate of 200 μL/min for a duration of 7.5 seconds (25 μL of sample consumed). The rod was mounted flat onto a standard stainless steel Matrix Assisted Laser Desorption Ionization target plate and was coated with α-cyano-4-hydroxycinnamic acid ("CHCA"). The CHCA matrix was sprayed at a concentration of 5 mg/mL in a solution of 70/30 acetonitrile/water (0.2% trifluoroacetic acid) at a flow rate of 20 μL/min. The spray raster was repeated for 30 passes to ensure that an even coating was produced.

The matrix-coated rod/plate was then subjected to vacuum Matrix Assisted Laser Desorption Ionization mass spectrometry imaging using an orthogonal acceleration Time of Flight mass spectrometer. According to this example multiple separate regions of the sample were ionised and mass analysed so as to generate a Matrix Assisted Laser Desorption Ionization ion image intensity maps (i.e. an ion map) of at least a portion of the sample deposited upon the target surface.

Figure 8A:
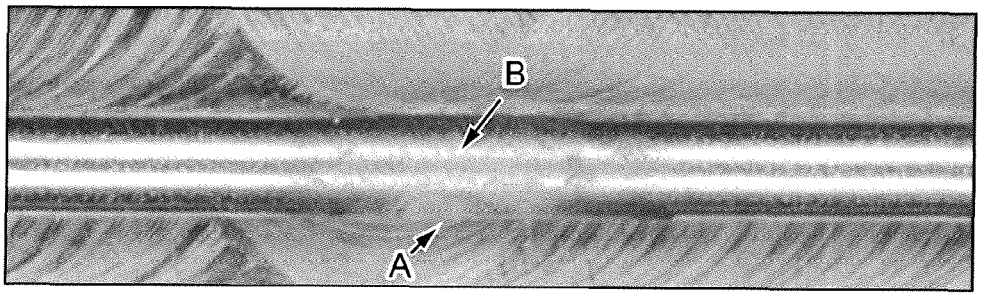
FIG. 8A shows an image of a target rod attached to a plate prior to covering the deposited sample with a matrix.

FIG. 8A shows an image of a rod and a corresponding plate which was taken prior to the CHCA coating stage. FIG. 8A shows an impact spot A where the spray first makes contact with the rod and a series of fine striations B where the sample material has migrated radially from the impact spot under the influence of the high velocity gas flow.

Figure 8B:
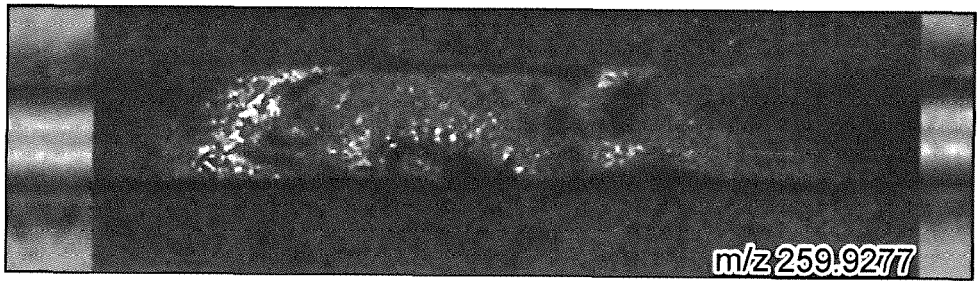
FIG. 8B shows a MALDI ion image intensity map for ions having a mass to charge ratio of 259.9277.
Figure 8C:
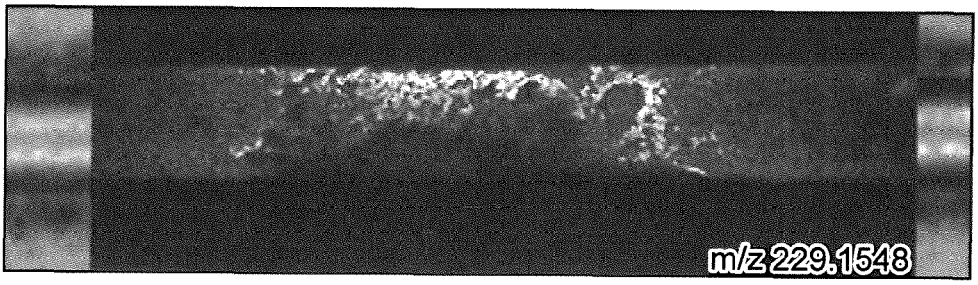
FIG. 8C shows a MALDI ion image intensity map for ions having a mass to charge ratio of 229.1548
Figure 8D:
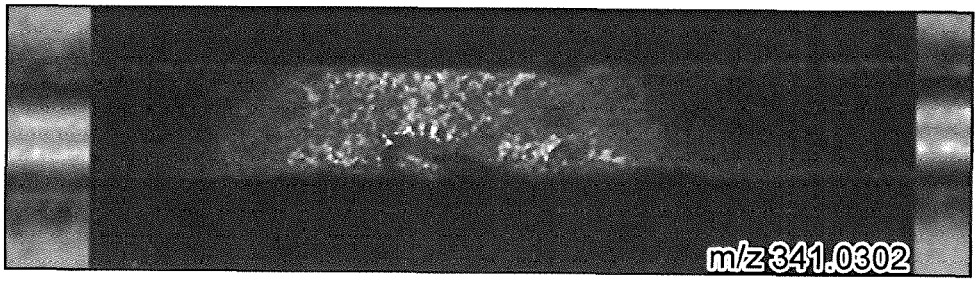
FIG. 8D shows a MALDI ion image intensity map for ions having a mass to charge ratio of 341.0302.

FIGS. 8B-D show resulting Matrix Assisted Laser Desorption Ionization ion image intensity maps obtained for three different mass to charge ratio values namely m/z 259.9277, 229.1548 and 341.0302 respectively. In all the images the ion intensity increases in the order black to white.

FIG. 8B shows evidence of radial striations wherein the ion intensity increases with radial distance from the impact spot. Conversely, FIG. 8C shows an ion intensity distribution that decreases with radial distance from the impact spot. FIG. 8D exhibits a more uniform distribution but still exhibits a significant void region along the periphery of the impact spot.

The data shown in FIGS. 8B-8D demonstrates that compound dependent two dimensional separations can be rapidly obtained for complex samples without the need for time consuming sample preparation or conventional chromatographic means. Furthermore, the separations can be conducted on surfaces which are optimal for Matrix Assisted Laser Desorption Ionization mass spectrometry or alternative MS imaging techniques.

According to a further embodiment tracer molecules may be seeded into a spray or spotted onto the surface of engineering components that are subjected to high velocity gas flows. If the geometry of the component is amenable to Matrix Assisted Laser Desorption Ionization mass spectrometry imaging then the resulting images will reveal surface flow patterns that could be used to validate computational fluid dynamics ("CFD") model data. An example would be the surface flow on a scaled aircraft wing.

Embodiments are contemplated comprising a combination or combinations of the various embodiments described above which may be utilised to effect a pseudo-separation of analyte mixtures on a target prior to MALDI MS analysis.

Figure 7:
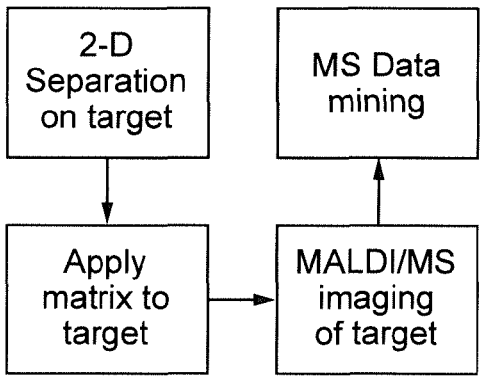
FIG. 7 shows a flow diagram which illustrates the processes according to an embodiment.

Furthermore, any of the various embodiments described and contemplated above may also be implemented by adding a MALDI matrix or matrices into the analyte mixture prior to the pseudo-separation step. With reference to the tide mark effect described above, embodiments are contemplated wherein a mixture of matrices are added so as to cover a wide polarity range. This embodiment eliminates the second stage of the process described above in relation to the preferred process as illustrated in FIG. 7.

Although the present invention has been described with reference to preferred embodiments, it will be understood by those skilled in the art that various changes in form and detail may be made without departing from the scope of the invention as set forth in the accompanying claims.

The invention claimed is:

1. A method of ion mapping comprising:

depositing a sample onto a metallic target surface;

separating said sample on said target surface according to a first physico-chemical property in a first dimension and according to a second physico-chemical property in a second dimension; and ionising and mass analysing multiple separate regions of said sample so as to generate an ion map of at least a portion of said sample deposited upon said target surface;

wherein said sample is deposited onto and separated on said target surface by mechanical, hydrodynamic and/or aerodynamic means.

2. A method as claimed in claim 1, wherein said first dimension is orthogonal to said second dimension, and/or wherein said first dimension comprises a first spatial dimension and said second dimension comprises a second spatial dimension.

3. A method as claimed in claim 1, wherein said sample comprises a liquid sample, wherein said sample is dissolved in a liquid solvent, and/or further comprising applying a liquid solvent to said sample on said target surface.

4. A method as claimed in claim 1, wherein said target surface comprises a substantially non-porous and/or substantially even target surface.

5. A method as claimed in claim 1, wherein said steps of depositing and separating said sample further comprise depositing said sample onto said target surface using a nebuliser, sample syringe or sample spotter.

6. A method as claimed in claim 1, wherein said steps of depositing and separating said sample further comprise introducing a sample into a gas spray and impacting said spray upon said target surface.

7. A method as claimed in claim 1, wherein said steps of depositing and separating said sample further comprise forcing a sample deposited onto said target surface to traverse along said target surface under the influence of a gas and/or liquid flow.

8. A method as claimed in claim 1, wherein said steps of depositing and separating said sample further comprise dispersing a sample deposited onto said target surface along said target surface under the influence of gravity.

9. A method as claimed in claim 1, wherein said steps of depositing and separating said sample further comprise spreading a sample deposited onto said target surface.

10. A method as claimed in claim 1, wherein said steps of depositing and separating said sample further comprise heating said sample and/or said target, and/or translating, moving, rotating, vibrating and/or agitating said target.

11. A method as claimed in claim 1, wherein said first physico-chemical property and/or said second physico-chemical property comprise mass, mass to charge ratio, ion mobility, diffusivity, interaction cross section, surface bonding, surface affinity, liquid surface affinity, solubility, solution solubility, ion pairing affinity, binding affinity or polarity.

12. Apparatus comprising:

a target having a metallic target surface;

a first device arranged and adapted to deposit a sample onto said target surface and to separate said sample on said target surface according to a first physico-chemical property in a first dimension and according to a second physico-chemical property in a second dimension by mechanical, hydrodynamic and/or aerodynamic means; and a second device arranged and adapted to ionise and mass analyse multiple separate regions of said sample so as to generate an ion map of at least a portion of said sample deposited upon said target surface.

13. A method of ion mapping comprising:

providing a sample on a metallic target surface;

separating said sample on said target surface according to a first physico-chemical property in a first dimension and according to a second physico-chemical property in a second dimension; and ionising and mass analysing multiple separate regions of said sample so as to generate an ion map of at least a portion of said sample on said target surface;

wherein said sample is separated on said target surface by mechanical, hydrodynamic and/or aerodynamic means.

14. Apparatus comprising:

a target having a metallic target surface;

a first device arranged and adapted to separate a sample provided on said target surface according to a first physico-chemical property in a first dimension and according to a second physico-chemical property in a second dimension by mechanical, hydrodynamic and/or aerodynamic means; and a second device arranged and adapted to ionise and mass analyse multiple separate regions of said sample so as to generate an ion map of at least a portion of said sample on said surface of said target.

15. A method as claimed in claim 10, wherein spreading a sample deposited onto said target surface comprises spreading said sample deposited onto said target surface using a blade.

* * * * *